US007614523B1

(12) United States Patent
Fixler et al.

(10) Patent No.: US 7,614,523 B1
(45) Date of Patent: Nov. 10, 2009

(54) BEVERAGE CUP DRIP COLLAR

(76) Inventors: Don S. Fixler, 9875 Cunningham Rd., Cincinnati, OH (US) 45243; Chris Fixler, 9875 Cunningham Rd., Cincinnati, OH (US) 45243

( * ) Notice: Subject to any disclaimer, the term of this patent is extended or adjusted under 35 U.S.C. 154(b) by 131 days.

(21) Appl. No.: 11/734,918

(22) Filed: Apr. 13, 2007

(51) Int. Cl.
*B65D 23/06* (2006.01)

(52) U.S. Cl. ..... 220/738; 215/392; 215/394

(58) Field of Classification Search ..... 220/738, 220/737; 215/392, 393, 394
See application file for complete search history.

(56) References Cited

U.S. PATENT DOCUMENTS

| | | | | | |
|---|---|---|---|---|---|
| 134,302 | A | * | 12/1872 | Miller | 215/392 |
| 811,742 | A | * | 2/1906 | Petrie | 215/392 |
| 1,924,926 | A | * | 8/1933 | Gray | 215/394 |
| 2,321,519 | A | * | 6/1943 | Rubinoff | 220/737 |
| 2,568,623 | A | * | 9/1951 | Hamm | 215/394 |
| 2,570,954 | A | * | 10/1951 | Kasman | 215/394 |
| 2,655,281 | A | * | 10/1953 | Davis | 215/394 |
| 2,685,318 | A | * | 8/1954 | Merkle | 215/395 |
| 2,856,095 | A | * | 10/1958 | Schnabel | 220/571.1 |
| 2,929,526 | A | * | 3/1960 | Steinberg | 215/393 |
| 2,948,452 | A | * | 8/1960 | Grogan et al. | 426/132 |
| 2,990,968 | A | * | 7/1961 | Pirman | 215/393 |
| 3,013,689 | A | * | 12/1961 | Shropshire | 215/394 |
| 3,063,590 | A | * | 11/1962 | Hopkins | 215/392 |
| 3,246,786 | A | * | 4/1966 | Holley | 215/393 |
| 4,340,146 | A | * | 7/1982 | Stratton | 215/394 |
| 4,499,741 | A | | 2/1985 | Harris | |
| 4,514,995 | A | | 5/1985 | Curtis et al. | |
| 5,349,739 | A | * | 9/1994 | Weder | 29/525 |
| D364,776 | S | * | 12/1995 | Gerke | D7/624.1 |
| D365,304 | S | * | 12/1995 | Weder et al. | D11/164 |
| D384,006 | S | * | 9/1997 | Weder et al. | D11/164 |
| 5,765,716 | A | | 6/1998 | Cai et al. | |
| 6,026,983 | A | * | 2/2000 | Graham | 220/738 |
| 6,053,352 | A | | 4/2000 | Cai | |
| D446,454 | S | | 8/2001 | Frank | |
| 6,286,709 | B1 | | 9/2001 | Hudson | |
| D455,935 | S | * | 4/2002 | Detiveaux | D7/624.2 |
| 6,374,540 | B1 | * | 4/2002 | Garcia | 47/72 |
| 6,749,082 | B1 | | 6/2004 | Nickel | |
| 6,799,581 | B2 | | 10/2004 | Cave | |

(Continued)

FOREIGN PATENT DOCUMENTS

| | | | |
|---|---|---|---|
| CA | 2489609 | A1 | 6/2006 |

OTHER PUBLICATIONS

Declaration of Dr. Don S. Fixler executed Sep. 13, 2007 ( 2 pages ).

*Primary Examiner*—Anthon Stashick
*Assistant Examiner*—Niki M Eloshway
(74) *Attorney, Agent, or Firm*—Wood, Herron & Evans, LLP

(57) ABSTRACT

A drip collar (10, 110) is provided with a radially outwardly extending absorbent web (30, 114) so as to define a hand-receiving space (50) therebelow when mounted to a sidewall (16) of a cup (5) in which the thumb (52) and finger(s) (54) of a hand (56) can grasp the cup sidewall (16) with the web (30, 114) substantially encircling the cup sidewall (16) and extending over the thumb (52) and finger(s) (54) when the cup (5) is grasped. The absorbent web (20, 114) controls drips (61, 62) from the cup drinking end (12).

23 Claims, 2 Drawing Sheets

U.S. PATENT DOCUMENTS

2002/0000446 A1 1/2002 Taylor
2004/0182780 A1* 9/2004 Lee ..... 210/610
2004/0195254 A1 10/2004 Bunkers

* cited by examiner

BEVERAGE CUP DRIP COLLAR

FIELD OF THE INVENTION

The present invention relates to controlling drips from beverage cups such as coffee cups and, more particularly, to a drip collar therefor.

DESCRIPTION OF PRIOR ART

Consumers often buy beverages, such as hot coffee, in tapered cylindrical cups, and drink the beverage from the cup while on the run, rather than sitting at a table with a saucer and napkin. The consumer may be walking, driving, reading a newspaper, or doing other activities such as working at a desk or on a laptop computer while they are consuming their beverage. Full attention is thus often focused on other than careful consumption of the beverage.

Today's beverage cups, and particularly coffee cups, typically have a top end that is open, or openable, for drinking, a closed bottom end, and a sidewall extending between and connecting the two ends, with the interior of the cup defined by the sidewall and bottom end holding the beverage, such as coffee. The top end typically is larger in diameter than the bottom end, with the cup sidewall being tapered between the top and the bottom ends. Many such cups are made of paper board or the like to be disposable. A drinking lid is often attached to the top end after the cup has been filled. The drinking lid may be adapted to allow the consumer to drink through the lid, such as through an opening thereof.

The cup sidewall is sized to be grasped between the thumb and fingers of a human hand. Drips tend to fall down over and/or along the sidewall onto the user's thumb and fingers. Such drips can occur from the area of contact between one's lips and the opening in the lid, or between the lips and the top opening of the cup when a lid is not used. Drinking while undertaking other activity such as driving, walking, or working, makes it even more likely that drips will occur since activity can cause relative motion or poor alignment between one's lips and the opening, especially if an unexpected movement occurs such as would be caused by a bump in the road. Drips may also occur when there is a poor seal between the lid and the opening.

Drips are not only an annoyance, they can result in soiling hands, clothing or nearby surfaces. When the beverage involved is hot coffee, the drips can also be a serious distraction. Various attempts have been made to provide mechanisms to reduce or even catch drips. By way of example, it has been proposed to provide a drip collar in the form of a tubular member adapted to be removably mounted over the sidewall of the cup, and having a rigid flange extending radially outwardly therefrom such as shown in Cai et al U.S. Pat. No. 5,765,716 ("Cai"). That device mounts on the cup by inserting the cup through the opening of the tubular member such that the flange defines a hand-receiving space therebelow in which the user may grasp the cup sidewall between the thumb and fingers, with the rigid flange blocking drips from falling directly onto the user's thumb and fingers. With that device, however, drips can accumulate on the flange and become a further source of drips.

Another proposal has been to provide a reservoir on the outer periphery of the tubular member to accumulate the drips, such as set out in Eid Canadian Patent Publication 2,489,609 ("Eid"). An absorbent material can be placed in the reservoir to hold the drips. That design also presents drawbacks, not the least of which is that the user's fingers and thumb are still exposed to drips as it is sized for the user to grip it about the outer periphery outwardly of the reservoir.

SUMMARY OF THE INVENTION

The present invention provides an improved drip collar that overcomes various drawbacks of prior drip collars, such as those described above. To that end, and in accordance with principles of the present invention, the drip collar is provided with a radially outwardly extending web of absorbent material, such as fabric or paper, and is sized to mount to the cup such that the absorbent web substantially encircles the cup sidewall above a midline thereof with the absorbent web extending radially outwardly over the fingers and thumbs of the user when the cup is grasped. The absorbent web provides the protective benefit achieved with the flange of Cai patent, while absorbing drips to avoid the accumulation of loose fluid that the rigid flange created. Similarly, the absorbent web provides the benefits of absorbing the drips as with Eid, but provides protection to the user's thumb and fingers not shown to be provided in Eid. The absorbent web may also have a portion that contacts the cup sidewall so as to absorb drips that might otherwise roll down the cup sidewall within the drip collar.

In one exemplary embodiment, the drip collar takes the form of an absorbent annular ring of washable fabric with an elastic band enclosed therein. The washable fabric defines an absorbent web extending radially outwardly of the elastic band and includes an upper aspect that projects radially outwardly to a peripheral edge and a lower aspect that projects radially inwardly from the peripheral edge. The drip collar can be slid over the cup, such as from the bottom (or held open to fit over the top) and will hold in place due to the elastic band closing down around the sidewall with the absorbent web positioned above the area where the user would place the hands and fingers to grasp the sidewall of the cup. Such a drip collar may be provided by a ponytail scrunchie.

In another exemplary embodiment, a cardboard sleeve, such as a tapered, flexible cardboard tube segment typically used for insulating the user's hand when grasping the cup sidewall therethrough, includes a radially outwardly extending absorbent web substantially encircling the tube segment. When the sleeve is mounted in insulating relationship to the cup sidewall, the area below the web creates an area for the user to grip the sidewall of the cup, either directly or through the intermediary of the insulating sleeve.

By virtue of the foregoing, there is thus provided an improved drip collar that overcomes various drawbacks of prior drip collars. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
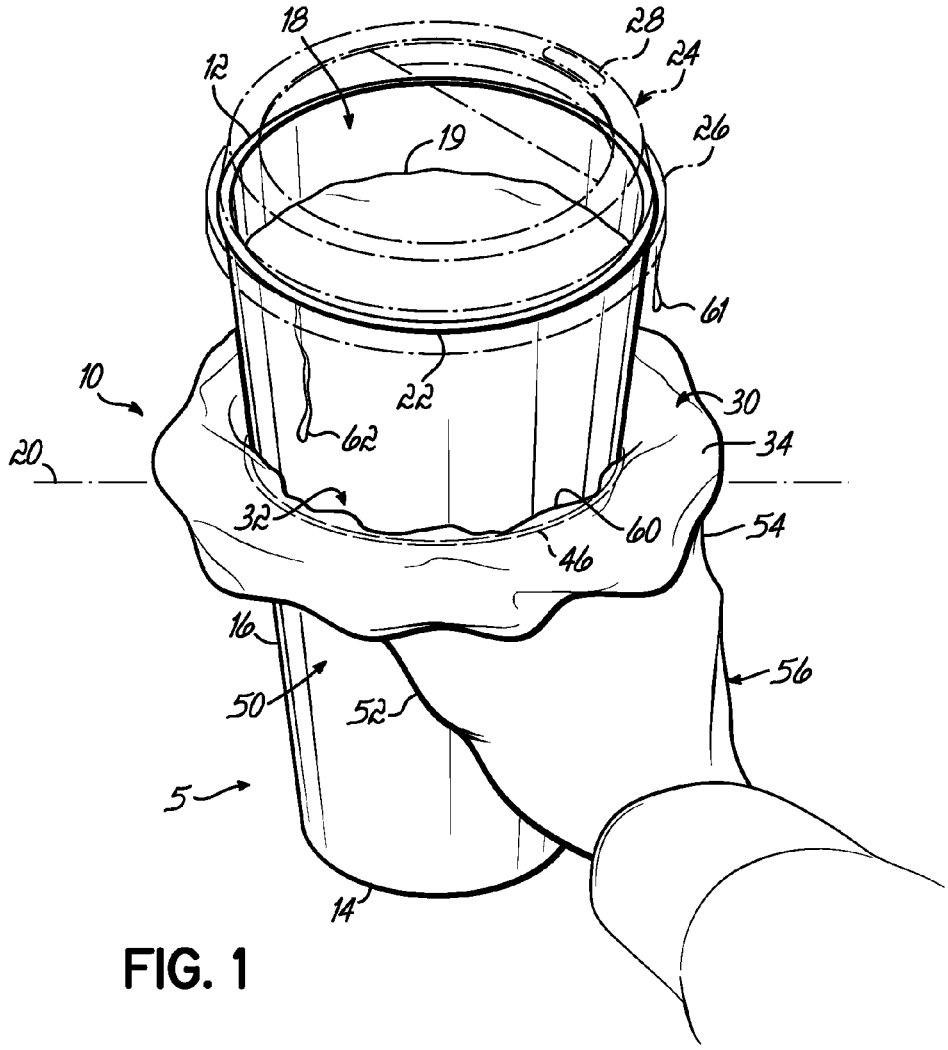
FIG. 1 is a perspective view, partially in phantom, showing a drinking cup in combination with one exemplary embodiment of a drip collar in accordance with the principles of the present invention.

With reference to FIG. 1, there is shown a drinking cup 5, such as a typical, disposable coffee cup, in combination with one exemplary embodiment 10 of a drip collar in accordance with the principles of the present invention. Cup 5 has a top drinking end 12, an opposite closed bottom end 14, and a solid sidewall 16 extending between and connecting ends 12 and 14. A beverage-holding space 18 is defined within cup 5 by cooperation of sidewall 16 and closed bottom end 14 and in which the beverage 19, such as coffee, is normally held for drinking. Sidewall 16 may be tapered such as where top end 12 has a larger diameter than bottom end 14.

Dashed line 20 represents the midline of cup 5, i.e., a plane through cup sidewall 16 approximately midway between ends 12 and 14, for purposes to be explained below. Cup 5 may include a lip 22 at top end 12. A drink-through lid 24, shown in phantom, may optionally be mounted to top end 12 at lip 22. To that end, lid 24 has a receiving end 26 into which lip 22 is received, and an opening (or an openable aperture) as at 28 through which to drink beverage 19 from space 18.

Figure 2:
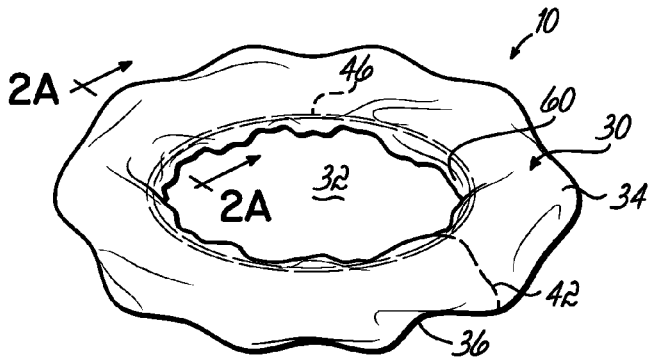
FIG. 2 is perspective view of the drip collar of FIG. 1.
Figure 2A:
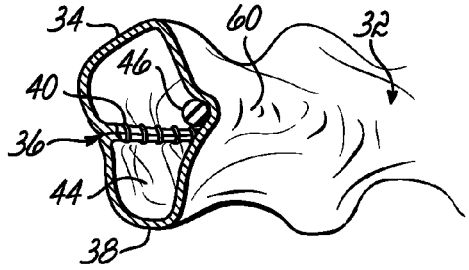
FIG. 2A is a cross-sectional view taken along line 2A-2A of FIG. 2.

Drip collar 10 in the embodiment of FIG. 1, and shown in greater detail in FIGS. 2 and 2A, includes a radially outwardly extending absorbent web 30 made of washable fabric, and defining an opening 32 therein and through which to receive cup 5 as will be explained. Web 30 has an upper aspect 34 extending radially outwardly of opening 32 to a peripheral edge 36 and a lower aspect 38 extending from edge 36 radially inwardly toward opening 32. Aspects 34 and 38 are joined together at edge 36 such as by stitching 40 and folded into a tube and joined as by stitching at 42 to form web 30 into an annular ring. Fitted within the interior 44 of the ring is an elastic band 46 which defines a minimum diameter of opening 32 but which allows opening 32 to expand to snugly fit against sidewall 16 of cup 5.

Cup 5 may be inserted, bottom end 14 first, into opening 32 of drip collar 10. Alternatively, drip collar 10 may be stretched to pass over top end 12 (and lid 24 if present). Drip collar 10 is sized so as to be received in encircling relationship with sidewall 16 of cup 5 above the closed end 14 thereof and to define below the radially outwardly extending web 30 a hand-receiving space 50 in which sidewall 16 may be grasped between the thumb 52 and finger(s) 54 of a human hand 56 with web 30 extending over most of the thumb 52 and finger (s) 54 as seen in FIG. 1. Advantageously, drip collar 10 is sized and positioned such that web 30 is above midline 20 of cup 5 so that it extends radially outwardly over the thumb 52 and finger(s) 54 when the cup is grasped, rather than having any portion of the web grasped by the thumb and/or finger(s).

Drip collar 10, when thus positioned on cup 5 serves to provide a protective function to attempt to catch and absorb drips such as an airborne drip 61 or sidewall rolling drip 62, that might fall from the area of top end 12 rather than have them fall onto the hand 56 and/or other nearby surfaces or collect up into larger drips.

The web 30 of drip collar 10 also has an interior aspect 60 whereat upper and lower aspects 34 and 38 merge. Interior aspect 60 in the exemplary embodiment of drip collar 10 contacts sidewall 16 of cup 5 so as to also catch and absorb rolling drips 62 that might otherwise roll down sidewall 16 and pass below drip collar 10.

In use, drip collar 10 is mounted to cup 5 to thus control drips 61 and/or 62. While it is not practical to completely protect the hand 56 due to variations in the size and shape of the hand 56 and the ways in which the cup 5 may be grasped, drip collar 10 will catch and absorb many drips 61 and/or 62 thereby providing control of drips without various drawbacks of prior drip collars.

While cup 5 is shown as having a tapered sidewall 16, a non-tapered sidewall may be employed and drip collar 10 would work thereon as well. Further, while elastic band 46 is shown as encircling sidewall 16 from within the annular ring of web 30, other constructions can be devised with the elastic band exposed, by way of example. Further, the elastic band 46 need not extend completely in a circle so as to encircle the cup 5, but could instead be made up of smaller segments of elastic band spaced apart through the web 30. Also, while not shown in FIG. 1, an insulating tapered, flexible cardboard tube segment could be mounted to cup sidewall 16 such as in or extending through hand-receiving space 50.

Figure 3:
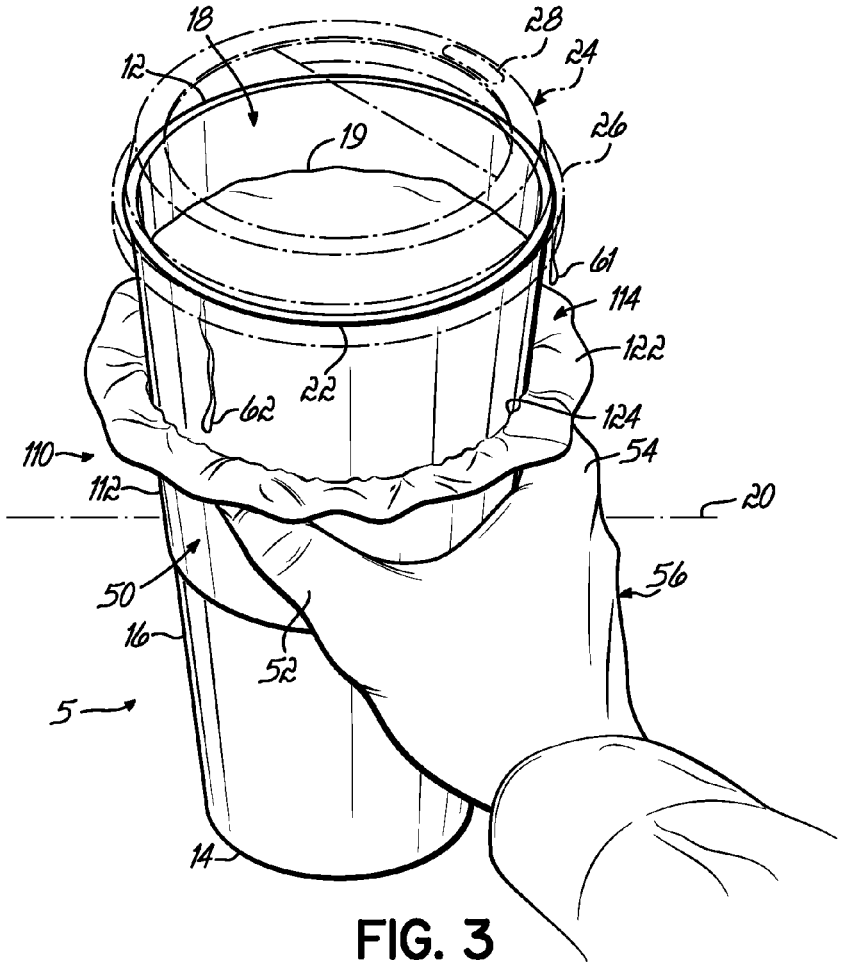
FIG. 3 is a perspective view, partially in phantom, showing the drinking cup from FIG. 1 in combination with a second exemplary embodiment of a drip collar in accordance with the principles of the present invention.
Figure 4:
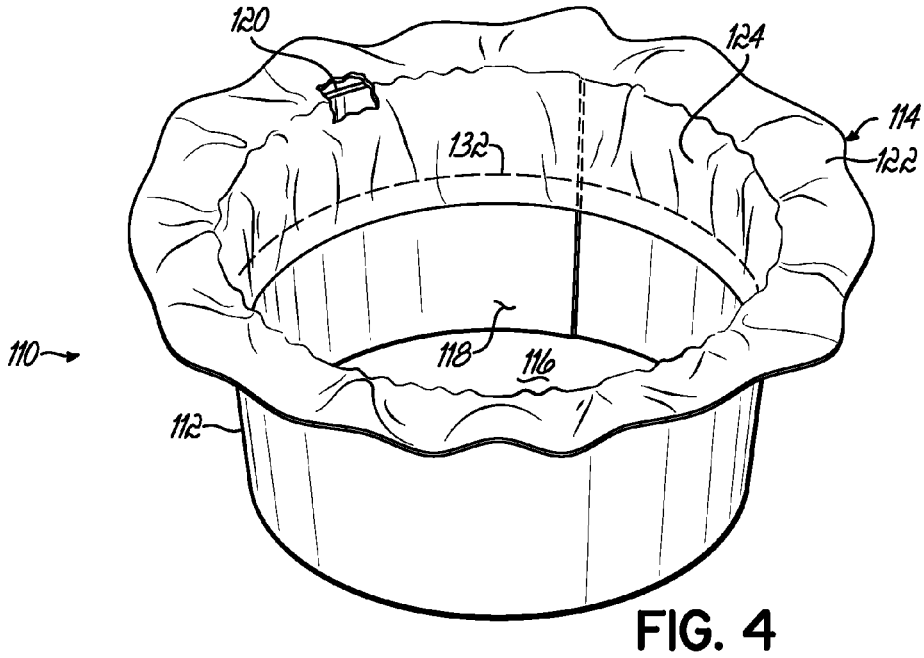
FIG. 4 is a perspective, partially cut-away view of the drip collar of FIG. 3.

With reference to FIG. 3, cup 5 is shown in combination with a second exemplary embodiment 110 of a drip collar in accordance with the principles of the present invention. Drip collar 110 includes a tapered, flexible cardboard tube segment 112 such as the type typically mounted by sliding onto coffee cups, such as cup 5, in insulating relationship with sidewall 16, and an absorbent web 114 extending about tube segment 112. To that end, tube segment 112 can be provided in flattened form (not shown) and then opened up to define an opening 116 encircled by the cardboard wall 118 of segment 112 as seen in FIG. 4. Wall 118, when opened into the tubular form, may be tapered to match the taper of sidewall 16 of cup 5. Absorbent web 114 is attached to wall 118, such as along the upper periphery 120 thereof. Web 114 may be of flexible paper or fabric, and has a radially outwardly extending aspect 122 to provide the protective function over the thumb 52 and finger(s) 54. Web 114 may also have an inner aspect 124 extending within opening 116 so as to contact sidewall 16 when mounted to cup 5. Web 114 may be secured to wall 118 with stitching 132, such as through wall 118 and inner aspect 124, or may be secured by other means, an example of which might be adhesive. Alternatively, tube segment 112 and web 114 may be integrally formed. Further alternatively, aspects 122 and 124 could be separate absorbent webs (not shown).

In use, cup end 14 is slid into opening 116 of tube segment 112 until snug on sidewall 16 in insulating relationship therewith. Aspect 122 of web 114 extends radially outwardly of segment 112 to define hand-receiving space 50 therebelow for purposes as above described in relation to web 30 of drip collar 10 with web 114 providing control of drips 61 and 62. The thumb 52 and finger(s) 54 may grasp sidewall 16 in hand-receiving space 50, either directly and/or indirectly through the wall 118.

By virtue of the foregoing, there is thus provided an improved drip collar that overcomes various drawbacks of prior drip collars While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. By way of example, while the drip collars are shown as completely encircling sidewall 16, through 360 degrees, it will be appreciated that a drip collar in accordance with the principles of the present invention may be formed to extend less than 360 degrees, so as to mount to the cup in substantial encircling relationship, rather than fully encircling same. To that end, there could be a gap, especially where the thumb 52 and finger(s) 54 are confronting (not shown), as that area may not need protection. Similarly, the absorbent web could extend less than 360 degrees and so could also have a gap to thereby substantially encircle the cup sidewall 16 (and the tube segment 112 in the drip collar 110, for example). Further, while the absorbent web is shown herein as generally being the upper-most aspect of the drip collar, it could be situated, at least in part, lower along the length of the drip collar. Further, while the absorbent webs are shown as being quite flexible, they could be stiff or the drip collar could include a stiff or rigid member associated therewith. The invention in its broader aspects is, therefore, not limited to the specific details, representative apparatus and method, and illustrative examples shown and described. Accordingly, departures may be made from such details without departing from the spirit or scope of the general inventive concept.

Having described the invention, what is claimed is:

1. In combination:

a drinking cup having a top drinking end, an opposite closed bottom end, and a sidewall extending therebetween, the sidewall and closed end cooperating to define a beverage-holding space, the sidewall sized to be grasped between the thumb and fingers of a human hand; and a drip collar received on and substantially encircling the cup sidewall, the drip collar having an upper extent with an opening through which the cup sidewall extends and a lower extent with an opening through which the cup sidewall extends, the drip collar including an absorbent web substantially encircling the cup sidewall above a midline thereof and extending radially outwardly sufficient to define a hand-receiving space therebelow in which the sidewall may be grasped between the thumb and fingers of a human with the absorbent web extending substantially over the thumb and fingers, the drip collar being sized to be spaced above the closed bottom end and the midline of the cup such that the closed bottom end and hand-receiving space are both exposed, the absorbent web including an upper aspect extending radially outwardly to a peripheral edge and a lower aspect extending radially inwardly from the peripheral edge.

2. The combination of claim 1 wherein the drip collar fully encircles the cup.

3. The combination of claim 1 wherein the absorbent web fully encircles the cup.

4. The combination of claim 1 wherein the absorbent web contacts the cup sidewall.

5. The combination of claim 1 wherein the drinking cup is tapered from wide at the drinking end to narrow at the closed bottom end.

6. The combination of claim 5, the drip collar including a cardboard portion in contact with the cup sidewall.

7. The combination of claim 6:

wherein the cardboard portion extends into the hand receiving space but not to the closed bottom end such that the closed bottom end is exposed and is sized to be grasped between the thumb and fingers of a human hand whereby to grasp the cup sidewall through the cardboard portion.

8. The combination of claim 7 wherein the drinking cup is tapered from wide at the drinking end to narrow at the bottom end and the cardboard portion is tapered to substantially match the taper of the cup sidewall.

9. The combination of claim 6 wherein the drinking cup is tapered from wide at the drinking end to narrow at the bottom end and the cardboard portion is tapered to substantially match the taper of the cup sidewall.

10. The combination of claim 1, the upper and lower aspects cooperating to define an annular ring.

11. The combination of claim 10, the annular ring including an elastic band therein.

12. In combination:

a drinking cup having a top drinking end, an opposite closed bottom end, and a sidewall extending therebetween, the sidewall and closed end cooperating to define a beverage-holding space, the sidewall sized to be grasped between the thumb and fingers of a human hand; and a drip collar received on and substantially encircling the cup sidewall, the drip collar having an upper extent with an opening through which the cup sidewall extends and a lower extent with an opening through which the cup sidewall extends, the drip collar including an absorbent web substantially encircling the cup sidewall above a midline thereof and extending radially outwardly sufficient to define a hand-receiving space therebelow in which the sidewall may be grasped between the thumb and fingers of a human with the absorbent web extending substantially over the thumb and fingers, the drip collar being sized to be spaced above the closed bottom end and the midline of the cup such that the closed bottom end and hand-receiving space are both exposed, the drip collar including an elastic band encircling the cup sidewall.

13. The combination of claim 12, the elastic band being enclosed in the absorbent web.

14. The combination of claim 13, the drip collar being washable.

15. The combination of claim 1, the drip collar being washable.

16. The combination of claim 1, the absorbent web being of flexible paper.

17. The combination of claim 12, the absorbent web including an upper aspect extending radially outwardly to a peripheral edge and a lower aspect extending radially inwardly from the peripheral edge.

18. The combination of claim 12, the drip collar being washable.

19. A method for containing beverage drips from a drinking cup having a top drinking end, an opposite closed bottom end, and a sidewall extending therebetween, the sidewall and closed end cooperating to define a beverage-holding space, the sidewall sized to be grasped between the thumb and fingers of a human hand, the method comprising:

obtaining a drip collar having an opening sized to fit about said cup sidewall and a radially outwardly extending absorbent web, the absorbent web including an upper aspect extending radially outwardly to a peripheral edge and a lower aspect extending radially inwardly from the peripheral edge, the drip collar and absorbent web being sized to substantially encircle said cup sidewall while leaving said closed bottom end of said drinking cup exposed; and passing said cup through the drip collar opening to position the absorbent web substantially above a midline of said cup sidewall with the closed bottom end exposed so as to define a hand-receiving space below the drip collar in which said sidewall may be grasped between the thumb and fingers of a human with the absorbent web extending substantially over the thumb and fingers.

20. The method of claim 19 further comprising first obtaining said drinking cup.

21. A drip collar for use with a beverage cup having a tapered cylindrical sidewall and a closed bottom end, the drip collar comprising;

a tapered, flexible cardboard tube segment adapted to slide into insulating relationship with said tapered cylindrical beverage cup sidewall, the tube segment sized so as to engage with said sidewall such that no portion of the tube segment extends to said closed bottom end of said beverage cup; and a radially outwardly extending absorbent web extending substantially completely about the tube segment, the absorbent web including an upper aspect extending radially outwardly to a peripheral edge and a lower aspect extending radially inwardly from the peripheral edge.

22. The drip collar of claim 21, the absorbent web being flexible paper.

23. The drip collar of claim 21, the absorbent web extending completely about the tube segment.

* * * * *